US006375504B1

(12) United States Patent
Ito et al.

(10) Patent No.: US 6,375,504 B1
(45) **Date of Patent: *Apr. 23, 2002**

(54) CONNECTOR AND A CAP THEREFOR

(75) Inventors: Osamu Ito; Mitsuru Ito, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/689,389

(22) Filed: Oct. 12, 2000

Related U.S. Application Data

(63) Continuation of application No. 09/325,575, filed on Jun. 3, 1999, now Pat. No. 6,146,200.

(30) Foreign Application Priority Data

Jun. 4, 1998 (JP) ..... 10-156075

(51) Int. Cl.[7] ..... H01R 13/40

(52) U.S. Cl. ..... 439/596; 439/701; 439/752

(58) Field of Search ..... 439/596, 595, 439/752, 540.1, 701

(56) References Cited

U.S. PATENT DOCUMENTS

| | | | | |
|---|---|---|---|---|
| 5,454,733 | A | 10/1995 | Watanabe et al. | 439/540.1 |
| 5,509,829 | A | 4/1996 | Saba | 439/752 |
| 5,730,627 | A | 3/1998 | Okabe | 439/752 |
| 5,951,326 | A | 9/1999 | Okabe et al. | 439/596 |

*Primary Examiner*—Gary Paumen
*Assistant Examiner*—Alexander Gilman
(74) *Attorney, Agent, or Firm*—Anthony J. Casella; Gerald E. Hespos

(57) ABSTRACT

A cap is provided for preventing the deformation and breakage of tabs in a hood-less type male connector. The cap 3 is integrally made of a synthetic resin, and a cap main body 12 for surrounding tabs projecting from the front end surface of a connector housing 1 is formed at a front part of the cap 3. Behind the cap main body 12 is formed an engaging portion 11 for engaging the cap 3 with the connector housing 1. The engaging portion 11 is comprised of a tubular portion 11A to be mounted on a front end portion of the connector housing 1 and a pair of elastic pieces 11B extending from the left and right side walls of the tubular portion 11A. Further, retainer protecting ribs 16 project upward and downward from a rear end of the tubular portion 11A so as to prevent retainers 8 in their standby positions from shifting to their locking positions.

11 Claims, 11 Drawing Sheets

CONNECTOR AND A CAP THEREFOR

This application is a continuation of Application Ser. No. 09/325,575, filed Jun. 3, 1999, now U.S. Pat. No. 6,146,200.

BACKGROUND OF THE INVENTION

1. Field of the Invention

The present invention relates to a cap used for male connectors and female connectors and to a connector having such a cap.

2. Description of the Related Art

A prior art connector is identified by the numeral 100 in FIGS. 16 and 17 and is disclosed in Japanese Unexamined Utility Model Publication No. 7-32868. The prior art connector 100 is a male connector for accommodating male terminal fittings (not shown) therein, and is provided at its front part with a hood 101 for surrounding tabs of the male terminal fittings. A dust preventing cap 102 is provided at a front opening of the hood 101.

The hood 101 makes the prior art male connector 100 larger in vertical and transverse directions. Some installations have only a limited available space for the male connector 100. Thus, the male connector 100 may be forced to be smaller by omitting the hood 101. A module connector to be accommodated in a block connector does not require a hood after being accommodated in a main housing if a main connector is provided with a hood.

However, if the hood 101 is omitted from the male connector to solve the above described space problems, tabs of male terminal fittings are exposed from the front surface of the connector without being surrounded. Thus, the tabs may be deformed or broken if the male connector is left unconnected with a mating female connector.

In view of the above problem, an object of the present invention is to provide a hood-less (or receptacle-less) type connector capable of preventing fitting projecting portions, in particular tabs, from being deformed and/or broken and to provide a cap for that purpose. Another object of the present invention is to provide a simply constructed module connector of a block connector.

SUMMARY OF THE INVENTION

According to the invention, there is provided a cap (or connector cap) for a connector comprising a connector housing and terminal fittings which are at least partially inserted or insertable into cavities formed in the connector housing such that fitting projecting portions at the leading ends of the terminal fittings project from the front end surface of the connector housing without being surrounded. Thus, the connector is hoodless or receptacleless. The cap comprises a cap main body for substantially surrounding a projection space of the tabs, and a cap engaging portion is provided on the cap main body to engage with the connector housing. A detection opening is formed in the front surface of the cap main body to permit the insertion of a detection probe. The terminal fitting may be a male terminal fitting and the fitting projecting portions may be tabs.

According to a preferred embodiment, there is provided a cap for a male connector, and in particular for a hoodless or receptacleless male connector. The male connector comprises a connector housing. Male terminal fittings are inserted into cavities formed in the connector housing such that tabs provided at the leading ends thereof project from the front end surface of the connector housing without being surrounded. The cap comprises a cap main body for surrounding a projection space of the tabs. A cap engaging portion is provided on the cap main body and is engageable with the connector housing. A detection opening is formed in the front surface of the cap main body to permit the insertion of a detection probe. Accordingly, the tabs project from the front end surface of the connector housing without being surrounded, but are protected by the cap. As a result, deformation and breakage of the tabs can be prevented even if the male connector is left unconnected with its mating connector. Further, since the detection opening is formed in the front surface of the cap main body, the cap needs not be detached from the connector housing when the detection probe is brought into contact with the male terminal fittings for an electrical connection check.

The connector preferably comprises at least one retainer which is mounted in a side wall portion of the connector housing. The retainer can be pushed from a standby position to a locking position, and locks the male terminal fittings when reaching the locking position. The cap main body preferably comprises a retainer protecting rib which projects in the vicinity of the retainer in the standby position to prevent the retainer from inadvertently shifting to the locking position. Accordingly, the retainer protecting rib projecting in the vicinity of the retainer prevents the retainer from inadvertently shifting from the standby position to the locking position.

The connector may comprise at least one retainer which is mounted in a side wall portion of the connector housing such that it can be pushed from a standby position to a locking position. The retainer locks the male terminal fittings when reaching the locking position. The cap main body comprises a retainer protecting portion for substantially covering the retainer in the standby position, thereby preventing the retainer from inadvertently shifting from the standby position to the locking position.

Most preferably, the cap comprises connecting portions that interconnect a plurality of caps which are formed integrally or unitarily. The connecting portions preferably comprise perforations for separating adjacent caps from each other.

According to the invention, there is further provided a hoodless or receptacleless connector which comprises a connector housing. Terminal fittings are inserted at least partially into cavities in the connector housing so that fitting projecting portions provided at the leading ends of the terminal fittings project from the front end surface of the connector housing without being surrounded. The connector further comprises a removable cap with a cap main body for substantially surrounding a projection space of the fitting projecting portions. A cap engaging portion is provided on the cap main body and is detachably engageable with a housing side engaging portion provided on the connector housing.

According to a preferred embodiment of the invention, there is provided a hoodless or receptacleless male connector which comprises a connector housing. Male terminal fittings are inserted into cavities formed in the connector housing so that tabs provided at the leading ends of the male terminal fittings project from the front end surface of the connector housing without being surrounded. A cap main body surrounds a projection space defined by the tabs, and a cap engaging portion is provided on the cap main body so as to be detachably engageable with a housing side engaging portion provided on the connector housing. Accordingly, the detachably assembled cap prevents the deformation and breakage of the tabs if the male connector having no hood is left unconnected with its mating connector. Further, by providing no hood, the male connector can be made smaller.

Preferably, a plurality of male connectors are accommodated in a main housing to form a main connector. The housing side engaging portion acts also as an engaging portion for engaging the main housing and the male connector with each other. Accordingly, the housing side engaging portion provided on the connector housing can be engaged with both the cap and the main housing. Thus, the male connector need not have two engaging portions and has a simpler construction. Further preferably, the cap substantially covers the entire connector from its front end to its rear end. Most preferably, the connector is a male connector, the terminal fitting is a male terminal fitting and the fitting projecting portions are tabs.

According to a further aspect of the invention, there is provided a method for forming a plurality of caps, wherein the caps are unitarily or integrally formed, preferably by vacuum-forming. The caps are interconnected along connecting portions, and preferably are provided with perforations. Thus a necessary number of caps are separated along the connecting portions, preferably along the perforations thereof.

These and other objects, features and advantages of the present invention will become more apparent upon a reading of the following detailed description and accompanying drawings.

DETAILED DESCRIPTION OF THE PREFERRED EMBODIMENTS

Figure 1:
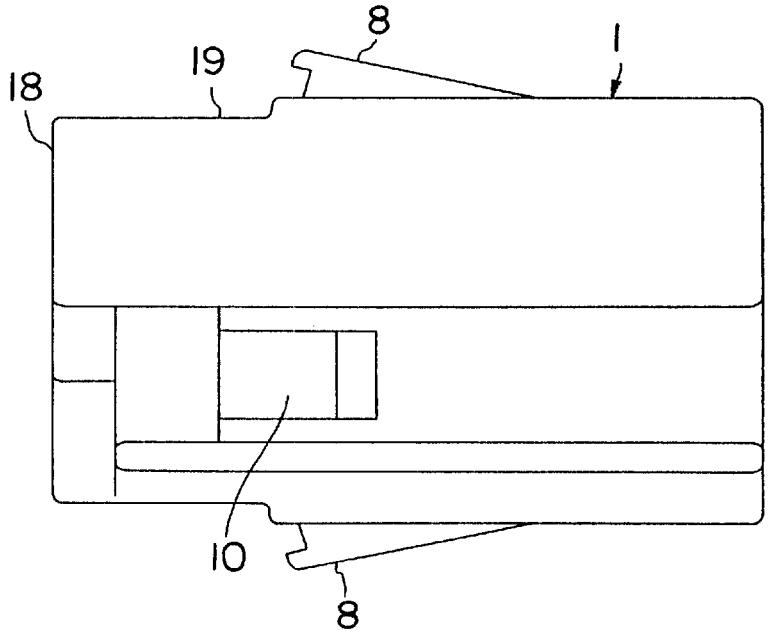
FIG. 1 is a side view of a connector housing according to a first embodiment.

FIG. 1 is a side view of a connector housing 1 of a male connector 17 in accordance with a first embodiment of the invention. The male connector 17 is a so-called module connector. As described later, with respect to FIGS. 10–12, a main housing 20 capable of accommodating a plurality of male connectors 17 is provided, and a main connector 21 is assembled by mounting the male connectors 17 in the main housing 20.

Figure 5:
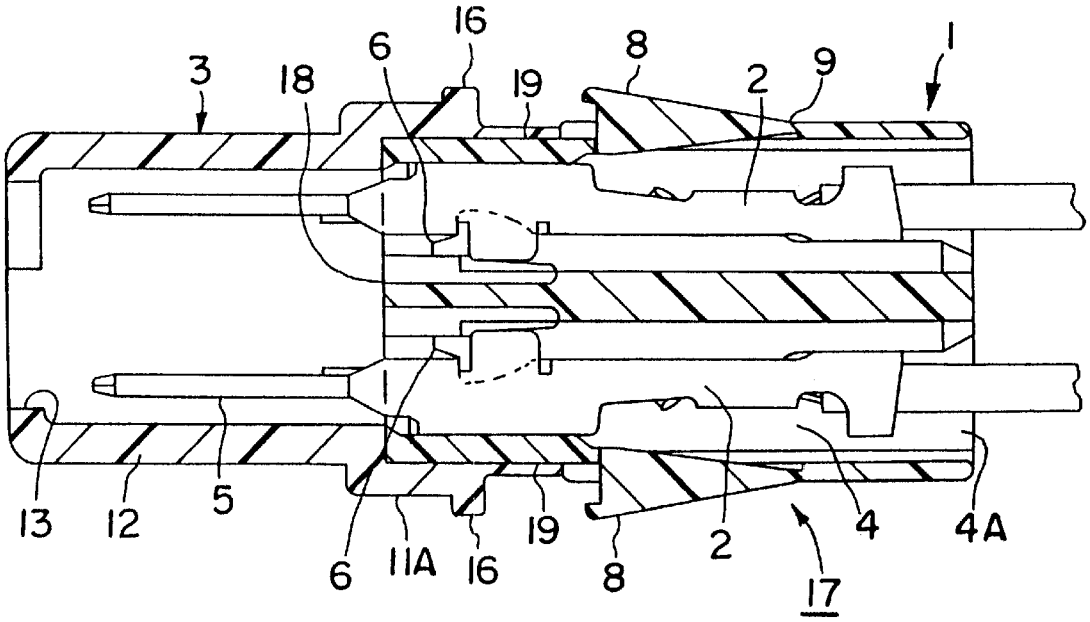
FIG. 5 is a side view in section of the connector housing assembled with the cap and having male terminal fittings mounted therein when the retainers in their standby positions.
Figure 6:
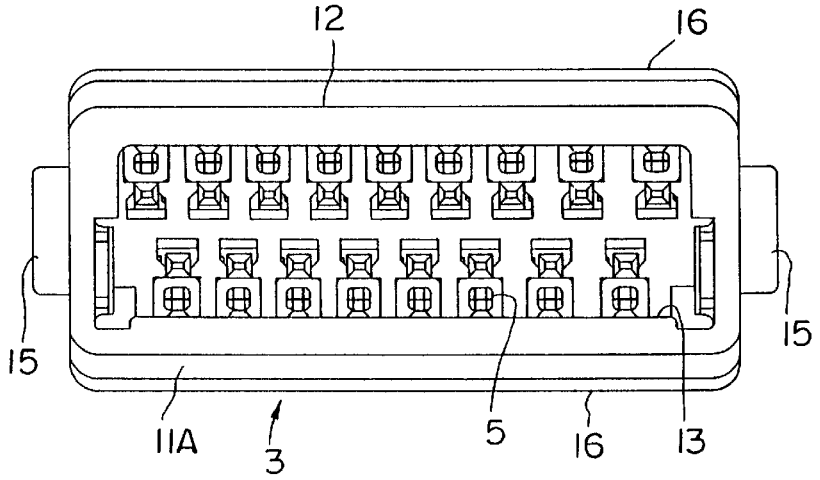
FIG. 6 is a front view of the connector housing assembled with the cap and having the male terminal fittings mounted therein.

The male connector 17 is provided with a connector housing 1 and male terminal fittings 2 are accommodated or accommodatable in the connector housing 1, as shown in FIG. 5. A tab 5 that is connectable with a mating female terminal fitting (not shown) extends at a front part of each male terminal fitting 2 (see particularly FIG. 5).

The connector housing 1 is made, e.g. of a synthetic resin, to have a substantially parallelepipedic shape and is connectable with a mating female connector housing (not shown) while substantially accommodating the male terminal fittings 2 therein. Cavities 4 are formed in the connector housing 1 for at least partially accommodating the male terminal fittings 2 (see FIG. 2). The cavities 4 penetrate the connector housing 1 along forward and backward directions, and openings at the rear of the connector housing 1 serve as terminal insertion openings 4A through which the male terminal fittings 2 are inserted or insertable. Further, openings at the front of the connector housing 1 serve as tab insertion openings 4B through which the tabs 5 of the male terminal fittings 2 are inserted. A front end surface 18 of the connector housing 1 is substantially in alignment with the positions of the tab insertion openings 4B. Thus, when the male terminal fittings 2 are mounted in the connector housing 1, the tabs 5 are exposed from the front end surface 18 of the connector housing 1 substantially without being surrounded. Further, a locking portion 6, which is elastically deformable in a lateral direction, e.g. upwardly and downwardly, projects from a part of a wall surface defining each cavity 4 so as to be engageable with the male terminal fitting 2.

At the lateral or left and right side walls of the connector housing 1, a pair of housing side engaging portions 10 project preferably backward (as seen in a mating direction MD (FIG. 7) of the male connector 17 with the cap 3). The housing side engaging portions 10 are elastically deformable inwardly and are engageable with cap side engaging portions 11 provided in the cap 3 to be described later.

Figure 2:
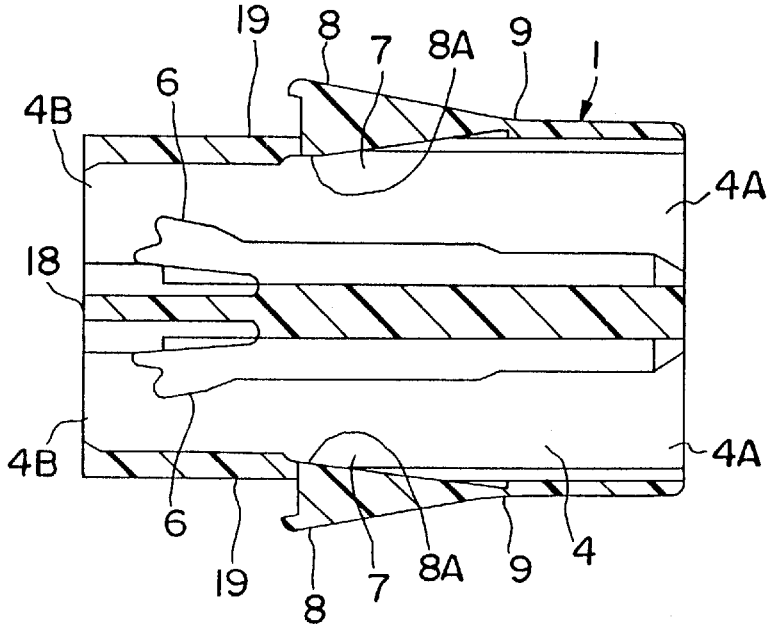
FIG. 2 is a side view in section of the connector housing.

Retainer mounting openings 7 are formed in the middle of upper and lower walls 19 of the connector housing 1 and communicate with the cavities 4, as shown in FIG. 2. A retainer 8 is mounted in each retainer mounting opening 7. The retainers 8 are integrally or unitarily formed with the connector housing 1 via hinges 9, and are rotatable or pivotable about the hinges 9. Further, a terminal engaging portion 8A projects from a surface of each retainer 8, which surface faces inwardly of the connector housing 1. The retainer 8 has two insertion positions where its depth of insertion into the retainer mount openings 7 differs. One insertion position where the retainer 8 is lightly inserted is a standby position where the insertion of the male terminal fittings 2 into the cavities 4 is permitted. Another insertion position where the retainer 8 is pushed deeper than in the standby position is a locking position. The outer surfaces of the retainers 8 are substantially flush with the outer wall surfaces of the connector housing 1 when the retainers 8 reach their locking positions, whereas they project from the outer wall surfaces of the connector housing 1 when the retainers 8 are in the standby positions.

Figure 3:
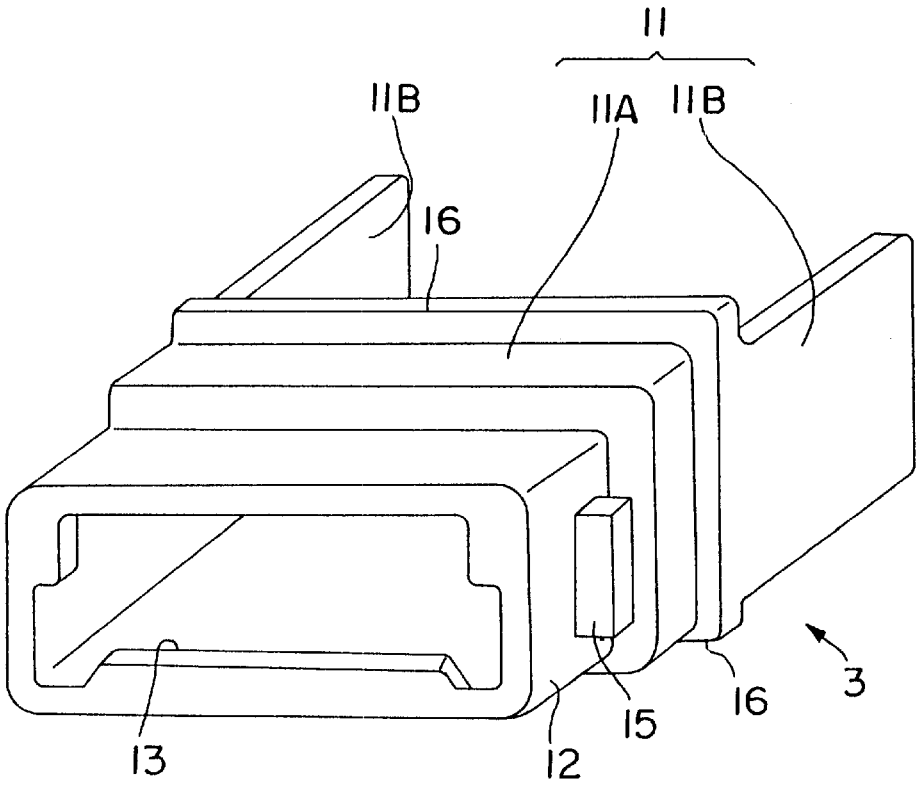
FIG. 3 is a perspective view of a cap.
Figure 4:
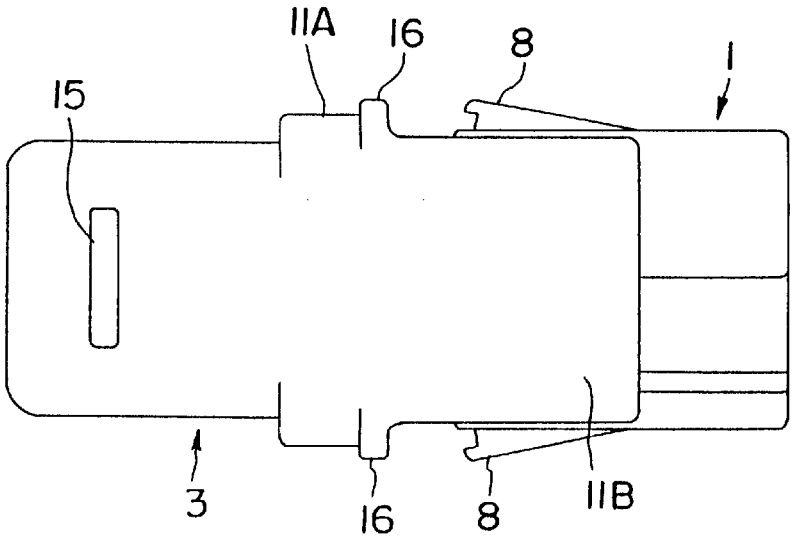
FIG. 4 is a side view of the connector housing assembled with the cap when retainers are in their standby positions.

FIG. 3 shows the cap 3. This cap 3 is integrally or unitarily made, for example, of a synthetic resin and is provided with a hollow cap main body 12 from its front part to its middle part and the cap side engaging portion 11 which is provided behind the cap main body 12 to engage the cap 3 with the connector housing 1.

The cap main body 12 has substantially the same outer dimensions as the connector housing 1 and is longer than the length of the tabs projecting from the front end surface 18 of the connector housing 1. When the cap 3 is mounted on the connector housing 1, the cap main body 12 substantially surrounds a projection space where the tabs 5 project. Further, a detection opening 13 is open in the front end surface of the cap main body 12. With the cap 3 and the connector housing 1 assembled with each other, the detection opening 13 permits the insertion of a detection probe 14 for an electrical conduction check when the male terminal fittings 2 are mounted in the cavities 4. A pair of grips 15 project from the left and right side wall surfaces of the cap main body 12. The cap 3 and the connector housing 1 can be assembled and detached smoothly by manoeuvring the grips 15.

Figure 7:
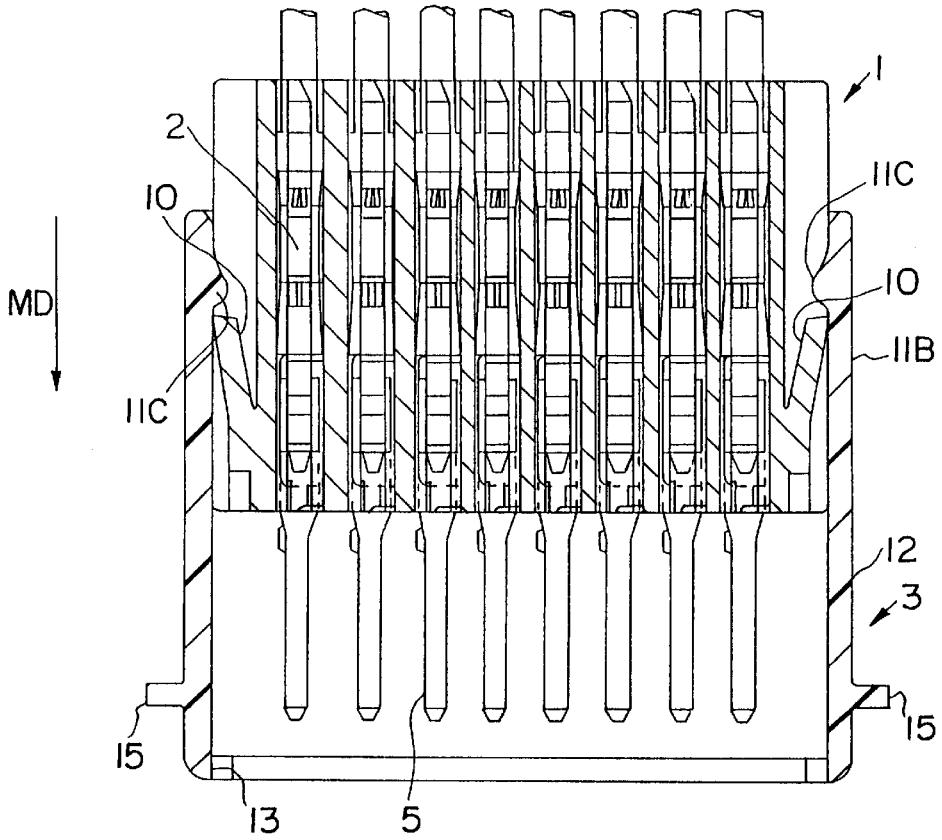
FIG. 7 is a plan view of the connector housing assembled with the cap and having the male terminal fittings mounted therein.

The cap side engaging portion 11 is formed at a rear end of the cap main body 12 and is comprised of a substantially tubular portion 11A for substantially covering a front end portion of the connector housing 1 and elastic pieces 11B extending backward from the left and right side walls of the tubular portion 11A. The tubular portion 11A is formed slightly larger than the cap main body 12, and the connector housing 1 is insertable into the tubular portion 11A. The elastic pieces 11B are elastically deformable sideways. At the leading end of each elastic piece 11B, a claw 11C projects inwardly, as shown in FIG. 7. The connector housing 1 and the cap 3 are substantially engaged by the engagement of the claws 11C and the housing side engaging portions 10 of the connector housing 1.

Retainer protecting ribs 16 project at rear end portions of the tubular portion 11A covering the upper and lower parts of the connector housing 1. The vertical projecting length of the retainer protecting ribs 16 when the cap 3 is mounted on the connector 1 is set to be equal to or slightly longer than the projecting length of the retainers 8 from the connector housing 1 in the standby position (see FIG. 5).

The male connector 17 and cap 3 are assembled by first rotating the retainers 8 of the connector housing 1 about the hinges 9 to the respective standby positions in the retainer mounting openings 7.

Next, the cap 3 is mounted on the front portion of the connector housing 1. When the front portion of the connector housing 1 is fitted into the tubular portion 11A of the cap 3, the elastic pieces 11B are deformed slightly elastically outward and the claws 11C are engaged with the housing side engaging portions 10 after moving over them as shown in FIG. 7. In this state, the cap side engaging portion 11 and the housing side engaging portions 10 are engaged to hold the connector housing 1 and the cap 3 locked. Further, at this time, the retainer protecting ribs 16 of the cap 3 project in the vicinity of or adjacent to the retainers 8. This prevents the retainers 8 from inadvertently shifting from the standby positions to the locking positions.

Subsequently, the male terminal fittings 2 are inserted into the cavities 4 of the connector housing 1. When the male terminal fittings 2 are pushed to their proper insertion positions, the locking portions 6 engage the male terminal fittings 2, thereby partly locking the male terminal fittings 2 in the cavities 4 (see FIG. 5). At this time, the tabs 5 project from the front end surface 18 of the connector housing 1 without being surrounded, but are protected by the cap 3. Accordingly, deformation and breakage of the tabs 5 can be prevented even when the male connector 17 is left unconnected with a mating connector.

Figure 8:
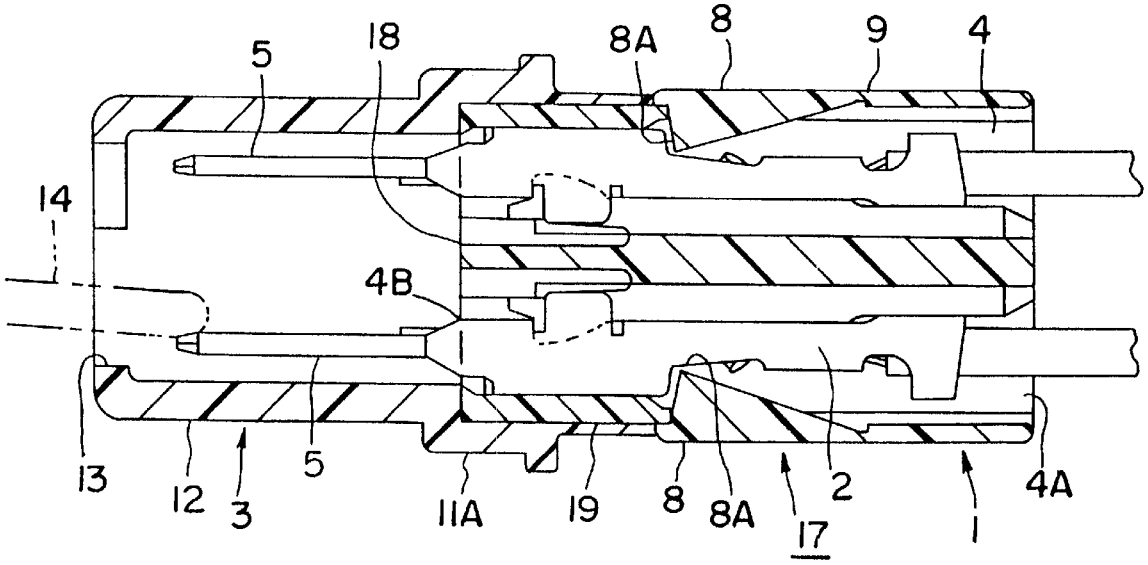
FIG. 8 is a side view in section of the male connector when the retainers are pushed to their locking positions.

Subsequently, when the retainers 8 are pushed from the standby positions to the locking positions, the terminal engaging portions 8A of the retainers 8 engage the male terminal fittings 2, thereby fully locking the male terminal fittings 2 in the cavities 4 (see FIG. 8). In this state, the detection probe 14 can be substantially inserted through the detection opening 13 formed in the front surface of the cap main body 12 when an electrical conduction check for the male terminal fittings 2 is performed. Thus, the electrical conduction check can be performed efficiently without making it necessary to detach the cap 3 from the male connector 17.

If the male connector 17 having no hood or receptacle (hood-less or receptacleless connector) is left unconnected with its mating connector, the deformation and breakage of the tabs 5 are prevented by the cap 3 detachably assembled. Further, by omitting the hood, the male connector 17 can be made smaller by the dimension of the hood.

Figure 9:
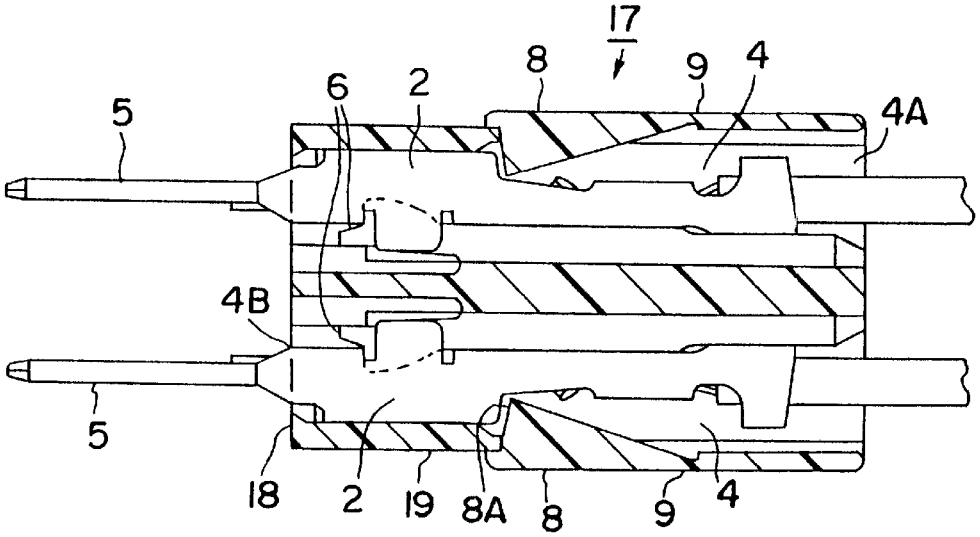
FIG. 9 is a side view in section of the male connector when the cap is detached therefrom.

The male connector 17 can be assembled into the main housing 20 after the cap 3 is detached therefrom (see FIG. 9). This assembling of the male connectors 17 into the main housing 20 is described with reference to FIGS. 10 to 12.

Figure 10:
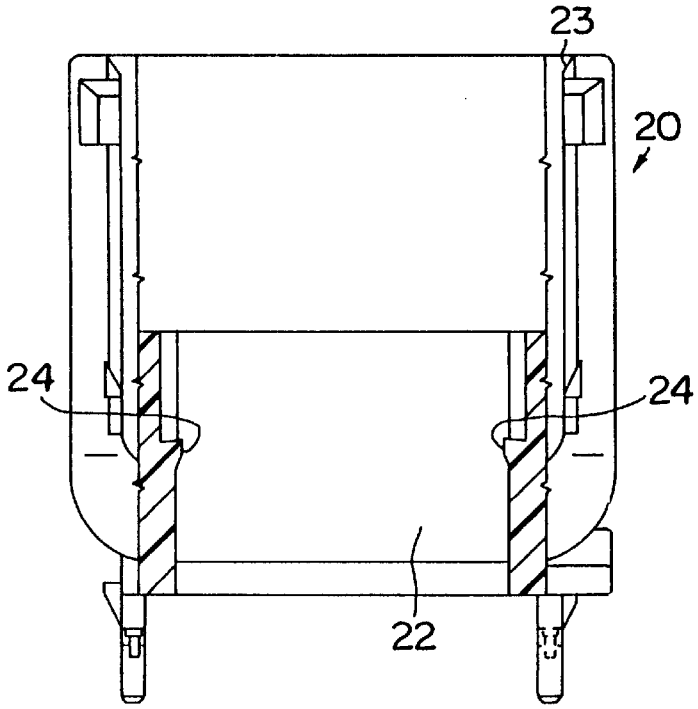
FIG. 10 is a side view in section of a main housing.
Figure 11:
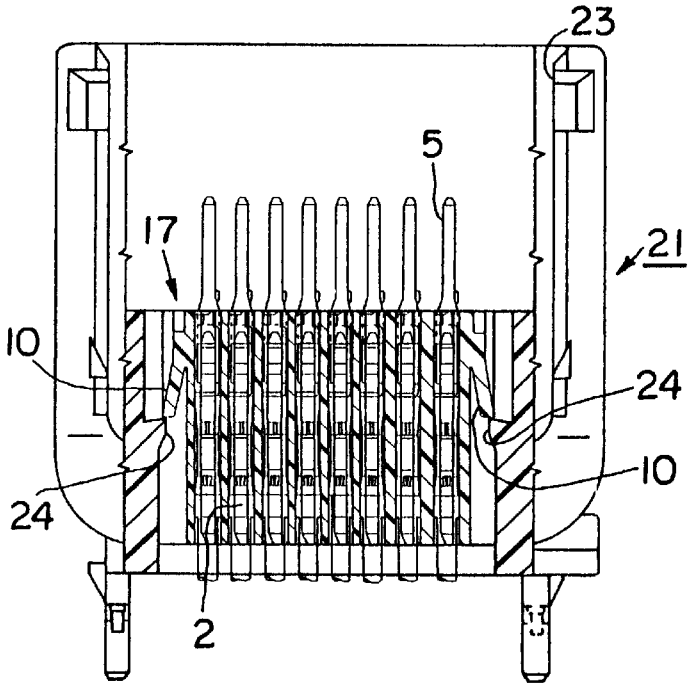
FIG. 11 is a side view in section of a main connector when the male connector is accommodated in the main housing.
Figure 12:
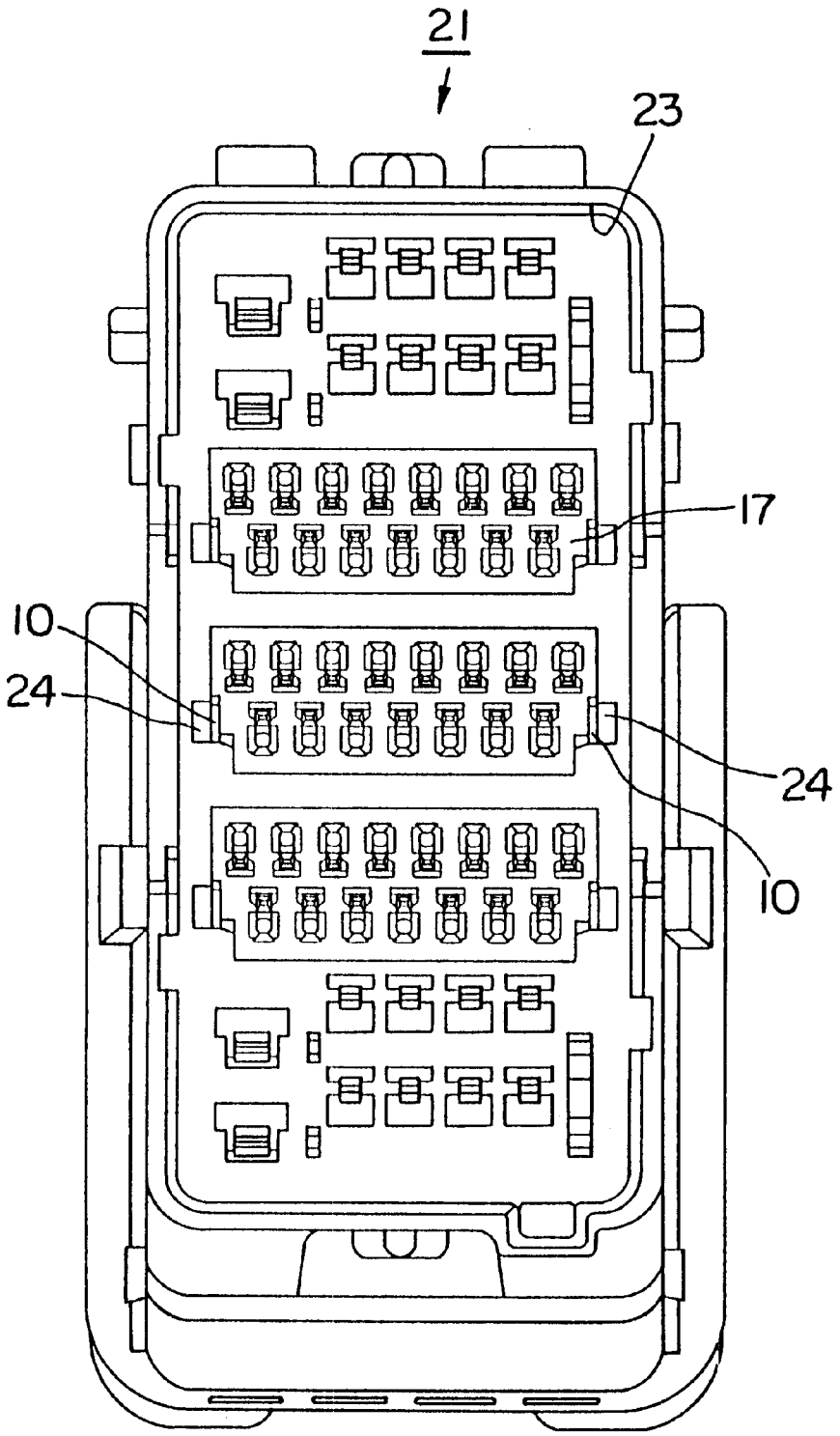
FIG. 12 is a plan view of the main connector.

The main housing 20 is integrally made e.g. of a synthetic resin and can accommodate a plurality of male connectors 17 therein. As shown in FIGS. 10–12, a plurality of connector accommodating chambers 22 in which the male connectors 17 are mountable are provided in the main housing 20. The connector accommodating chambers 22 penetrate the main housing 20 along forward and backward directions (a connecting direction of the main connector 21 with an unillustrated mating connector is assumed to be a forward direction). A hood or receptacle 23 capable of at least partially accommodating the mating connector is formed at a front part of the main housing 20. When the male connectors 17 are mounted in the main housing 20, the hood 23 substantially surrounds the tabs 5.

Connector engaging portions 24 are provided on one of the inner wall surfaces defining each connector accommodating chamber 22 which faces the housing side engaging portions 10 of the male connector 17. These connector engaging portions 24 are engageable with the housing side engaging portions 10 and prevent the male connector 17 from coming out of the main housing 20.

Each male connector 17 is mounted in the main housing 21 as follows. First, the male connector 17 is inserted into the corresponding connector accommodating chamber 22 from front. When the engaging portions 10, 24 are brought into contact with each other, the housing side engaging portions 10 are elastically deformed inward. When the male connector 17 is further pushed into the connector accommodating chamber 22, the housing side engaging portions 10 restore to their original shapes after moving over the connector engaging portions 24, with the result that the engaging portions 10, 24 are engaged with each other (see FIGS. 11 and 12). In this way, the assembling of the main connector 21 is completed.

As described above, in this embodiment, the housing side engaging portions 10 provided on the male connector housing 17 are engageable with the engaging portions 11, 24 of the cap 3 and the main housing 20. Thus, the male connector 17 does not need two kinds of engaging portions and, therefore, has a simpler construction.

Figure 14:
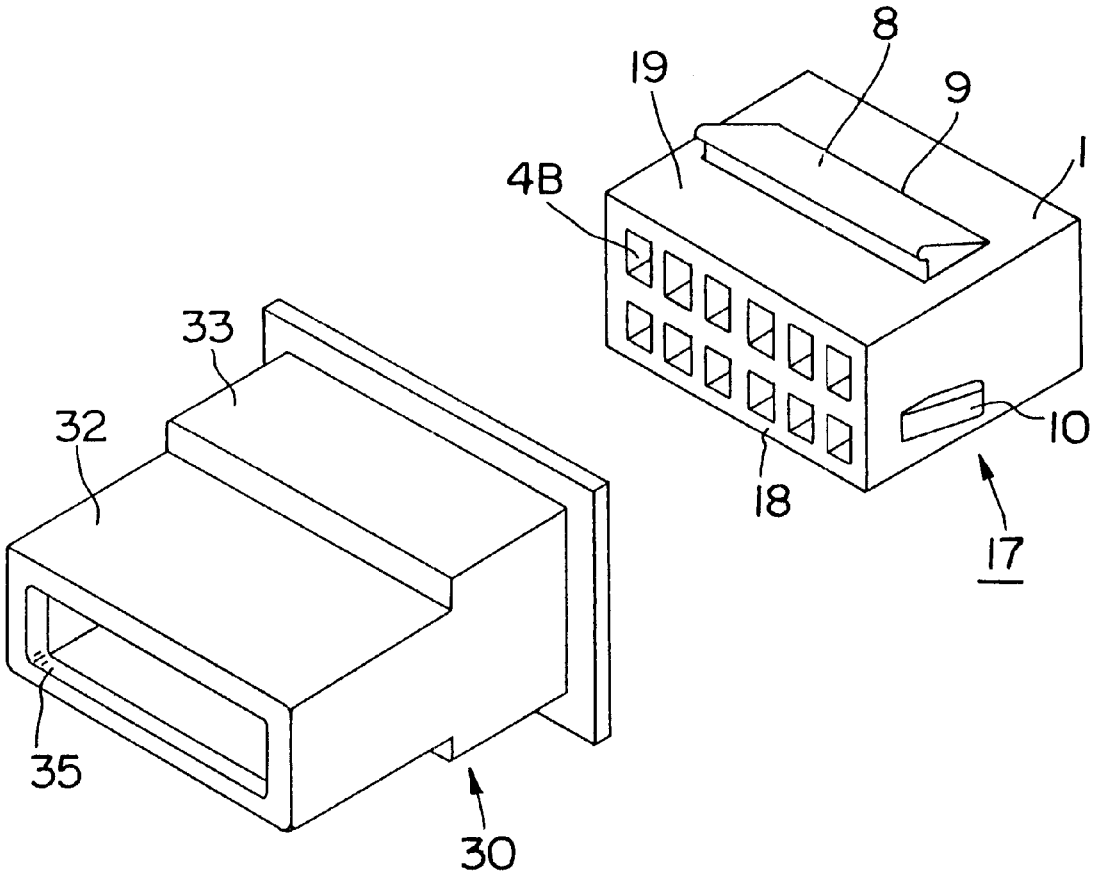
FIG. 14 is a perspective view of the male connector before the cap is assembled with the connector housing with the retainers in their standby positions.
Figure 15:
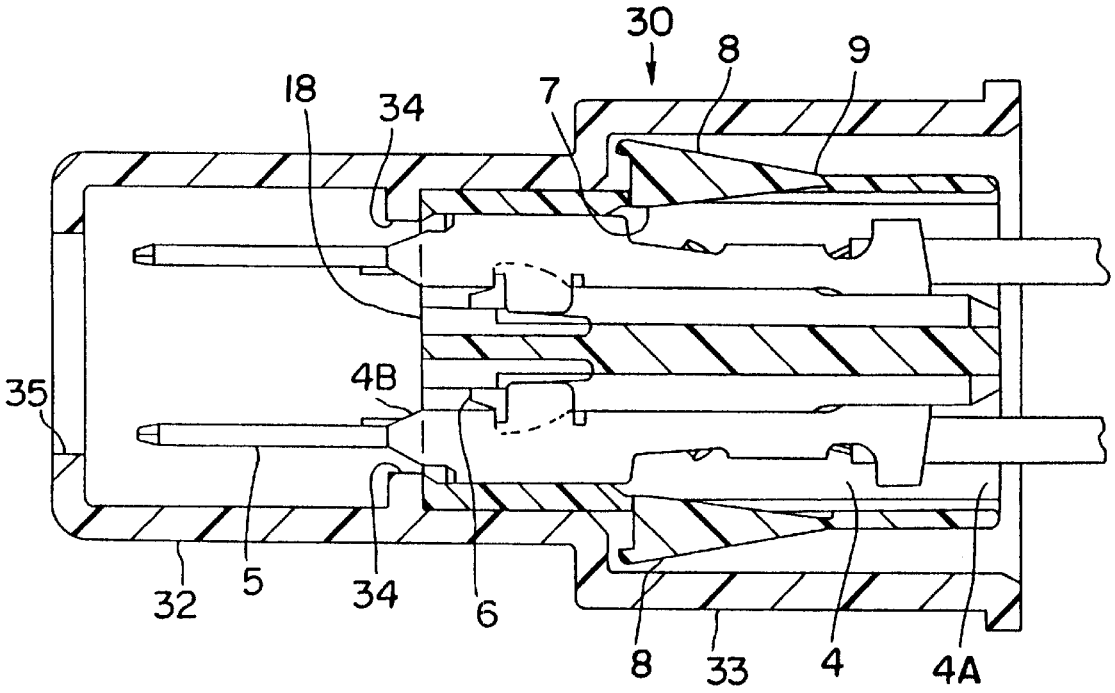
FIG. 15 is a side view in section of the connector housing assembled with the cap and having the male terminal fittings mounted therein.
Figure 16:
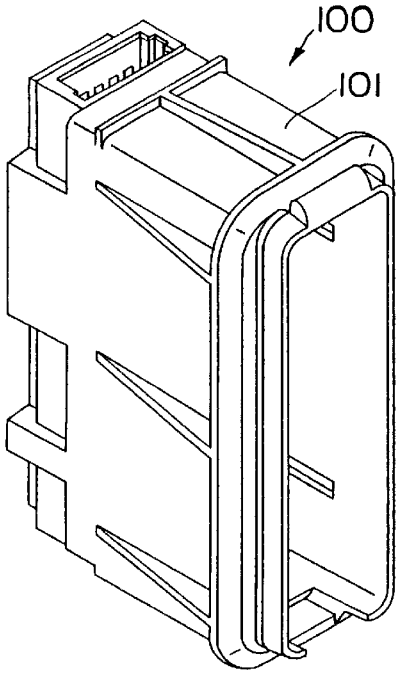
FIG. 16 PRIOR ART
FIG. 16 is a perspective view of a prior art connector.
Figure 17:
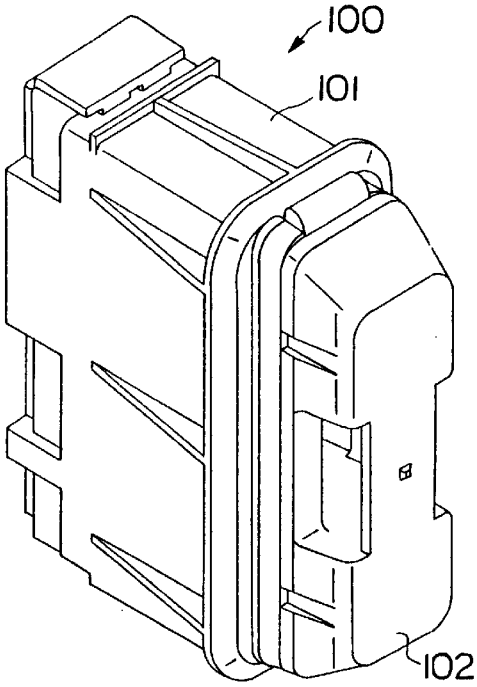
FIG. 17 PRIOR ART
FIG. 17 is a perspective view of the prior art connector when a dust preventing cap is assembled.

Next, a second embodiment of the invention is described with reference to FIGS. 13 to 15. The second embodiment differs from the first embodiment only in the shape of a cap 30. Accordingly, no description is given on the same or similar construction as the first embodiment by identifying it by the same or similar reference numerals.

Figure 13:
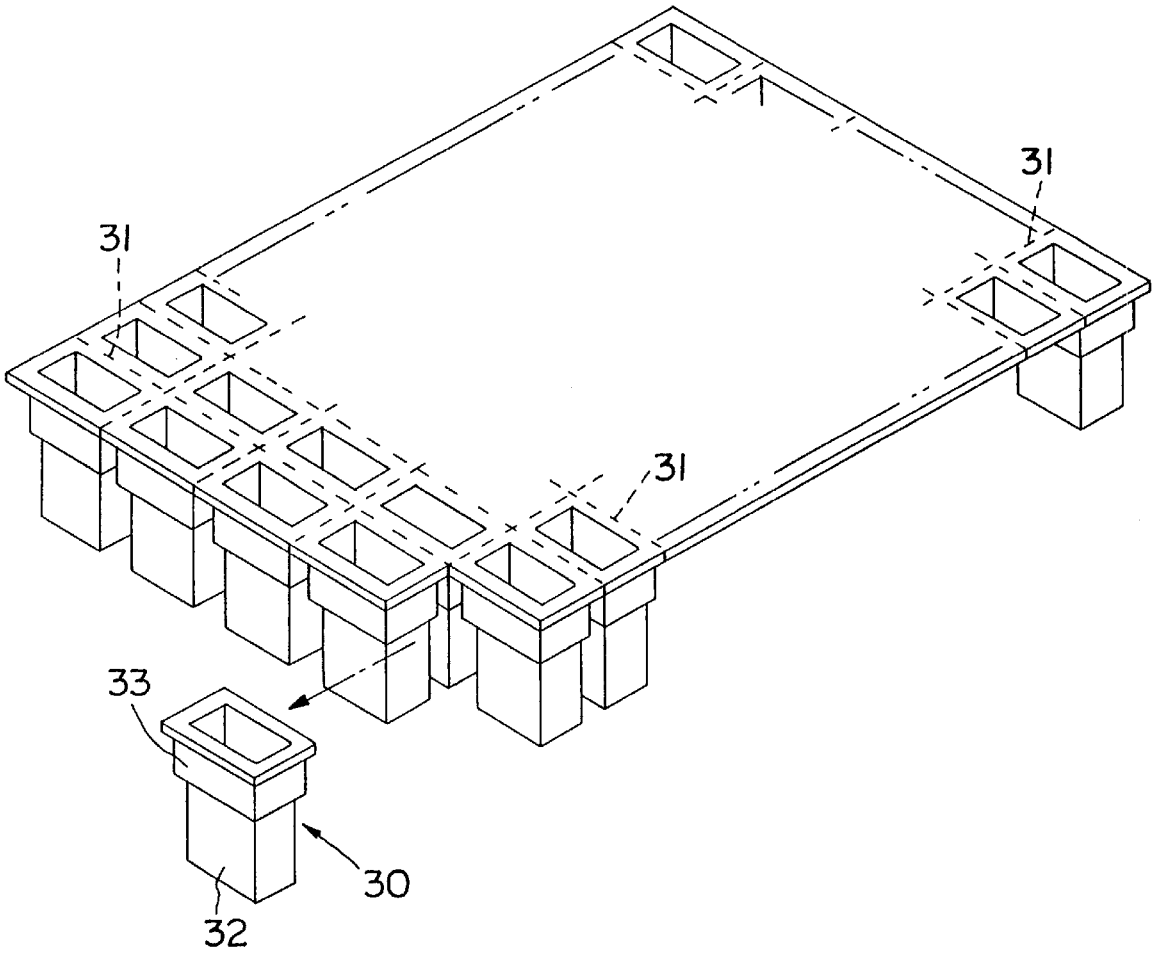
FIG. 13 is a perspective view of an assembly of caps according to a second embodiment.

FIG. 13 shows a plurality of caps 30 which are formed while being interconnected with each other. Such an assembly of the caps 30 is formed by, e.g. vacuum forming. Perforations 31 are formed in connecting portions of the respective caps 30. Depending on a necessary number of the caps 30, the caps 30 can be cut off along the perforations 31.

Each cap 30 is comprised of a cap main body 32 for substantially surrounding a projection space of the tabs 5 at a front side of the male connector 17 and a retainer protecting portion 33 provided at a rear part of the cap main body 32.

The inner configuration of the cap main body 32 is slightly larger than the outer configuration of the outer diameter of the connector housing 1, so that the cap 30 can be assembled to cover the outer wall surfaces of the connector housing 1. Further, contact portions 34 project from inner wall surfaces of the cap main body 32. The front end of the connector housing 1 is positioned in the cap 30 by the front end surface 18 of the connector housing 1 coming into contact with the contact portions 34 (see FIG. 15). A length between the contact portions 34 and the front end of the cap main body 32 is substantially longer than a projecting length of the tabs 5 from the front end surface 18 of the connector housing 1. Further, the front end surface of the cap main body 32 is formed with a detection opening 35 for permitting the insertion of the detection probe 14.

The retainer protecting portion 33 has upper, lower, left and right walls and substantially covers the retainers 8 in the assembled state of the cap 30. The position of the retainer protecting portion 33 is before the retainers 8 in their standby positions when the cap 30 is assembled with the male connector 17. The left and right side wall surfaces of the retainer protecting portion 33 extend along the left and right surfaces of the cap main body 32, whereas the upper and lower wall surfaces thereof are located above and below the cap main body 32. A distance between the upper and lower inner wall surfaces of the retainer protecting portion 33 and the upper and lower outer wall surfaces of the cap main body 32 is slightly longer than a projecting distance of the retainers 8 in their standby positions. Further, the rear end of the retainer protecting portion 33 is located slightly behind the rear end position of the male connector 17 when the cap 30 is assembled with the male connector 17 (see FIG. 15).

Though unillustrated, claws or connector engaging portions project on the inner wall surfaces of the retainer protecting portion 33 in positions corresponding to the housing side engaging portions 10 of the connector housing 1, and are adapted to engage the connector housing 1 and the cap 30 with each other.

The same action and effects as the first embodiment can be obtained by the second embodiment constructed as above.

Further, in this embodiment, the retainers 8 in the standby positions are prevented from shifting to the locking positions by being covered by the retainer protecting portions 33 when the cap 30 is assembled with the connector housing 1. Thus, as compared with the retainer protecting ribs 16 of the first embodiment, the retainer shift preventing function is further improved.

In addition, since the cap 30 substantially covers the entire male connector 17 from its front end to its rear end, it has a function of protecting the entire male connector 17.

Further, a plurality of caps 30 are integrally formed and interconnected via the perforations 31. Thus, a necessary number of caps 30 can be cut off to be used. Furthermore, since a batch of caps 30 are integrally formed, a production cost is lower as compared to a case where the caps 30 are individually formed.

The present invention is not limited to the foregoing embodiments. For example, the following embodiments are also embraced by the scope of the present invention as defined in the claims. Although the male connectors of the foregoing embodiments are module connectors, the present invention is also applicable to usual male connectors. According to the invention, the retainer protecting rib or the retainer protecting portion may not be provided on the cap.

What is claimed is:

1. A connector, comprising:

a plurality of connector housings each unitarily molded from a plastic material and having a front end and a rear end, at least one cavity extending through each said connector housing from the front end to the rear end thereof, and terminal fittings at least partially insertable into the cavity formed in each said connector housing, said terminal fittings having fitting projecting portions provided at leading ends thereof and projecting from the front end of each said connector housing without being surrounded, and a main housing integrally formed of a synthetic resin and having a rear end, a front end, an outer periphery extending between said front and rear ends, a hood extending rearwardly from the front end at the outer periphery and defining a receptacle extending into the front end, and a plurality of connector accommodating chambers extending forwardly from the rear end of the main housing and into the receptacle, said connector accommodating chambers having a plurality of connector engaging portions projecting into the connector accommodating chambers, the connector housings being configured for insertion into the connector accommodating chambers such that the hood substantially surrounds and protects all of the fitting projecting portions.

2. A connector according to claim 1, wherein the connector is a male connector, the terminal fitting is a male terminal fitting and the fitting projecting portions are tabs.

3. The connector of claim 2, wherein the connector housing comprises at least one locking portion projecting forwardly into the cavity, said terminal fitting having a locking aperture formed therein for locking engagement by the locking portion when the terminal fitting is inserted into the cavity.

4. The connector of claim 3, wherein the connector housing has upper and lower walls, at least one retainer formed on at least a selected one of the upper and lower walls, said retainer being selectively deflectable from a first position where said retainer is adjacent the cavity and a second position where the retainer projects into the cavity, the terminal fitting having a locking surface disposed for engagement by the retainer when the terminal fitting is inserted into the cavity and when the retainer is moved into the second position.

5. The connector of claim 4, wherein each said retainer includes opposed front and rear ends, the rear end of said retainer being hingedly and unitarily joined to the connector housing at a location in proximity to the rear end of the connector housing, said front end of the retainer projecting toward the front end of the connector housing.

6. The connector of claim 5, wherein the connector housing further includes side walls, a plurality of engaging portions being formed on the side walls of the connector housing, said engaging portions engage the engaging portion of the connector accommodating chamber in the main housing for locking the connector housing in the main housing.

7. The connector of claim 1, wherein the connector housing has upper and lower walls, at least one retainer formed on a selected one of the upper and lower walls, said retainer being selectively deflectable from a first position where said retainer is adjacent the cavity and a second position where the retainer projects into the cavity, the terminal fitting having a locking surface disposed for engagement by the retainer when the terminal fitting is inserted into the cavity and when the retainer is moved into the second position.

8. The connector of claim 7, wherein each said retainer includes opposed front and rear ends, the rear end of said retainer being hingedly and unitarily joined to the connector housing at a location in proximity to the rear end of the connector housing, said front end of the retainer projecting toward the front end of the connector housing.

9. The connector of claim 1, wherein the connector housing further includes opposed substantially parallel sidewalls between the opposed front and rear ends of the connector housing, at least one side engaging portion formed on at least one of the sidewalls of the connector housing for releasably engaging said connector housing with another structure.

10. The connector of claim 9, wherein the side engaging portions of the connector housings are engageable with the connector engaging portion in the connector accommodating chamber.

11. A connector, comprising:

a main housing integrally formed of a synthetic resin and having a rear end, a front end and a plurality of connector accommodating chambers extending therebetween, each said connector accommodating chamber having at least two connector engaging portions projecting into the respective connector accommodating chamber;

a plurality of connector housings, each said connector housing having a rear end, a front end and a plurality of outer walls extending between said front and rear ends, cavities extending through each said connector housing from the front end to the rear end, said outer walls defining a cross-section configured for insertion of said connector housings into the connector accommodating chambers, a plurality of retainers articulated to said outer walls of said connector housings, each said retainer being movable from a first position where inner portions of said retainer are adjacent the respective cavities and a second position where the inner portions of the respective retainer project into the respective cavity, the outer walls of each said connector housing further comprising at least one resilient engaging portion projecting outwardly and rearwardly from said outer wall;

a plurality of terminal fittings at least partially insertable respectively into the cavities of the connector housings, each said terminal fitting having a locking edge engaged by the inner portion of the respective retainer when the retainer is in the second position, whereby the retainers lock the respective terminal fittings in the cavities and whereby the engaging portions on the outer walls of the connector housings engage the engaging portions of the connector accommodating chambers in the main housing for locking the respective connector housings in the main housing.

* * * * *